US005210066A

United States Patent [19]

Sakurai et al.

[11] Patent Number: 5,210,066

[45] Date of Patent: May 11, 1993

[54] HEAT-SENSITIVE RECORDING MATERIAL

[75] Inventors: Shinziro Sakurai; Akihiro Yamazaki; Takeshi Yanagihara; Makoto Nakano; Masaya Kusumoto, all of Kanagawa, Japan

[73] Assignee: Mitsui Toatsu Chemicals, Inc., Tokyo, Japan

[21] Appl. No.: 631,933

[22] Filed: Dec. 21, 1990

[30] Foreign Application Priority Data

Dec. 28, 1989 [JP] Japan ..... 1-338213
Jul. 4, 1990 [JP] Japan ..... 2-176620
Aug. 10, 1990 [JP] Japan ..... 2-210247

[51] Int. Cl.[5] ..... B41M 5/40

[52] U.S. Cl. ..... 503/214; 427/152; 503/200; 503/226; 503/209

[58] Field of Search ..... 503/200, 226, 214, 209; 427/152

[56] References Cited

U.S. PATENT DOCUMENTS 4,682,192 7/1987 Nomura et al. ..... 503/226

FOREIGN PATENT DOCUMENTS 334607 9/1989 European Pat. Off. ..... 503/226
356069 2/1990 European Pat. Off. ..... 503/226
356962 3/1990 European Pat. Off. ..... 503/226
368318 5/1990 European Pat. Off. ..... 503/226
55-95593 7/1980 Japan .
57-19036 4/1982 Japan .
60-59193 4/1985 Japan .
61-284483 12/1986 Japan .
62-42884 2/1987 Japan .

*Primary Examiner*—Pamela R. Schwartz
*Attorney, Agent, or Firm*—Burns, Doane, Swecker & Mathis

[57] ABSTRACT

A heat-sensitive recording material wherein a copolymer emulsion is employed, the copolymer emulsion being obtained by copolymerizing a monomer component which comprises (meth)acrylamide and an optional unsaturated monomer component copolymerizable with (meth)acrylamide in the presence of a seed emulsion serving as a nucleating particle. In the heat-sensitive recording material, the intermediate layer, the heat-sensitive recording layer or the protective layer comprises the copolymer emulsion. The recordinq layer and the resulting recorded images of such a heat-sensitive recording material have sufficient durability (such as water resistance, heat resistance, resistance to plasticizers and resistance to solvents) and the resistance to heat softening of the protective layer. The heat-sensitive recording material can be produced through easy process control and is excellent in color developing sensitivity.

5 Claims, No Drawings

HEAT-SENSITIVE RECORDING MATERIAL

BACKGROUND OF THE INVENTION

1. Field of the Invention

The present invention relates to a heat-sensitive recording material and more specifically to a heat-sensitive recording material whose recording layer and hence the resulting recorded images are substantially improved in durability through the use of an emulsion of a specific copolymer in the intermediate layer, the recording layer or the protective layer thereof.

2. Description of the Prior Art

Presently, there have been widely and quickly applied a heat-sensitive recording material, in particular heat-sensitive recording paper, which comprises a substrate provided thereon with a heat-sensitive recording layer comprising a usually colorless or lightly colored chromophoric substance which is an electron donative substance, a phenolic compound or an electron acceptor which allows for the chromophoric substance to cause color development by heat and a binder as output recording paper for a variety of printers inclusive of facsimile; a printer for industrial instrumentation and for medical use; a POS system and a note issuing system.

However, various problems arise as the application thereof increases. For instance, the durability (such as water resistance, resistance to plasticizers and resistance to solvents) of recording layers and hence that of recorded images obtained after color development under the ordinary handling environment as will be detailed below are still insufficient. More specifically, there have been observed a variety of drawbacks such as peeling off of the recording layer when the heat-sensitive recording material is brought into contact with water, color development upon putting it on diazo light-sensitive paper immediately after copying, fading or discoloration due to plasticizers included in polyvinyl chloride upon putting it on a polyvinyl chloride mat or film and color development by the action of oils or solvents. These problems cannot be completely solved by the conventional techniques.

In general, there have been used, for instance, a known water-soluble polymer such as polyvinyl alcohol, methyl cellulose, hydroxyethyl cellulose, casein and polyvinyl pyrrolidone as binders for a heat-sensitive recording layer and an intermediate layer to be arranged between a substrate and the heat-sensitive recording layer. These binders of course have low water resistance and, for this reason, recorded color developable images are peeled off when they are brought into contact with water. Therefore, the most important object is to impart water resistance to heat-sensitive recording materials since the frequency of coming in contact with water is the highest in the usual circumstances and thus many attempts have been directed to this object. For instance, Japanese Patent Unexamined Publication (hereinafter referred to as "J. P. KOKAI") No. Sho 55-95593 discloses a method for enhancing the water resistance of a heat-sensitive recording material in which a combination of a polyvinyl alcohol and a butadiene-acrylate-styrene copolymer is used as a binder to cause self-crosslinking between them; J. P. KOKAI No. Sho 57-19036 discloses a method in which an isocyanate compound is added to a combination of a polyvinyl alcohol, an oxidized starch and an etherified starch serving as a binder; and J. P. KOKAI No. Sho 62-42884 discloses a method in which a combination of a polyvinyl alcohol, a latex and a crosslinking agent is employed as a binder.

However, in these methods wherein self-crosslinking is utilized or a crosslinking agent is added, the properties of a coating color for forming a heat-sensitive recording material vary with time, and heat required for the crosslinking agent to form sufficient crosslinks cannot be applied to heat-sensitive recording paper during the production thereof. For these reasons, a catalyst capable of causing crosslinking at ordinary temperature must be added and then the recording paper must be aged over a long time period. Moreover, these binders mainly comprise a water-soluble polymer and, therefore, if such a resin is used at a high concentration, the resulting coating color correspondingly has a high viscosity. This creates a variety of problems concerning process control. For instance, the workability of coating operations becomes low and further, an aqueous dispersion of a resin having substantially low heat resistance is inevitably used for improving the water resistance of the resulting heat-sensitive material and thus the heat resistance thereof is liable to be impaired. Thus, the efficiency of the process is greatly impaired.

As has been explained above, the methods for improving binders per se suffer from a variety of problems from the viewpoint of operations and the improvement in the water resistance and the resistance to plasticizers of the resulting recording material are also insufficient. For this reason, in fields in which recording materials having higher durability are required, there have been adopted methods in which a protective layer is applied onto a heat-sensitive layer and an improved binder is used. For instance, J. P. KOKAI No. Sho 61-284483 discloses a method in which an aqueous ultraviolet ray- or electron beam-curable resin system is incorporated into a binder and/or a protective layer; J. P. KOKAI No. Sho 60-59193 discloses a method in which a protective layer is formed from a composition containing a water-soluble resin and a crosslinking agent.

The method in which a UV ray- or electron beam-curable resin is used has advantages such as quick curing without heating, but they have only limited applications and these heat-sensitive materials are inferior to those obtained according to conventional ones from the viewpoint of cost, since the production line must be renewed or newly established and materials are expensive. In the method in which a protective layer comprising a water-soluble polymer and a crosslinking agent is used, the viscosity of a coating color of a resin becomes very high when the resin is used in a high concentration and correspondingly the workability is also lowered.

Moreover, since a crosslinking agent is an essential component of the coating color, problems concerning process control arise. For instance, the properties of the coating color vary with time, heat sufficient for ensuring a crosslinking reaction of the crosslinking agent cannot be applied to the coating color during the production of heat-sensitive layer and hence the coated layer must be sufficiently aged over a long time period.

In other words, the foregoing methods make it possible to solve the aforementioned problems to some extent, but these methods are not satisfactory in view of quality of the resulting heat-sensitive material inclusive of resistance to heat softening (resistance to sticking) of a protective layer optionally applied and from the viewpoint of process control.

SUMMARY OF THE INVENTION

Accordingly, one object of the present invention is to provide a heat-sensitive recording material which does not suffer from the foregoing problems, or whose recording layer and hence the resulting recorded images have a sufficient durability (water resistance, heat resistance, resistance to plasticizers, resistance to solvents or the like), whose protective layer optionally applied has high resistance to heat softening, which can be produced under easy process control and which has high color developing sensitivity.

The inventors of this invention have conducted various studies to solve the foregoing problems in the light of the consideration that an aqueous dispersion of a resin would be excellent in water resistance and workability, have found out that it is effective to use, in the production of a heat-sensitive recording material, an emulsion of a copolymer obtained by copolymerizinq unsaturated monomers mainly comprising (meth)acrylamide in the presence of a seed emulsion and have completed the present invention on the basis of this finding.

The present invention thus relates to a heat-sensitive recording material wherein an emulsion (e) of a copolymer obtained by copolymerizing an unsaturated monomer component (b) comprising (meth)acrylamide (c) and an optional unsaturated monomer (d) copolymerizable with the (meth) acrylamide (c) in the presence of a seed emulsion (a).

DESCRIPTION OF THE PREFERRED EMBODIMENTS

The aforementioned seed emulsion (a) is not restricted to a specific one and may be any known ones or those prepared according to known methods. Specific examples thereof include generally known polymer emulsions such as emulsions Of (meth)acrylate polymers, styrene/(meth)acrylate polymers, (meth)acrylonitrile polymers, styrene/butadiene polymers, (meth)acrylonitrile/butadiene polymers, (meth) acrylate/butadiene polymers, polyvinyl chlorides and polyvinyl acetates which may be used alone or in combination of two or more of them.

The glass transition point of the resins in the seed emulsions (a) varies depending on the amount thereof relative to that of the foregoing monomer component (b), but preferably ranges from 0° to 100° C. and more preferably 20° to 70°0 C. This is because, if the glass transition point is less than 0° C., the resulting heat-sensitive recording material is insufficient in heat resistance or resistance to sticking, while if it exceeds 100° C., the emulsion is often insufficient in film-forming ability. However, the present invention is not restricted by the glass transition point of the resin used at all.

(Meth)acrylamide (c) used in the present invention exhibits excellent heat resistance or resistance to sticking, resistance to plasticizers and resistance to solvents. The amount of (meth)acrylamide (c) used ranges from 50 to 100 parts by weight and preferably 70 to 100 parts by weight in 100 parts by weight of the monomer component (b). If it is less than 50 parts by weight, the resulting heat-sensitive layer does not show sufficient heat resistance, resistance to solvents and resistance to plasticizers.

Specific examples of the optional monomer components (d) copolymerizable with (meth)acrylamide (c) include (meth) acrylates such as methyl (meth)acrylate, ethyl (meth) acrylate, butyl (meth)acrylate, 2-ethylhexyl (meth)acrylate, 2-hydroxyethyl (meth)acrylate, 2-hydroxypropyl (meth) acrylate, 2-aminoethyl (meth-)acrylate, 2-(N-methylamino)ethyl (meth)acrylate, 2-(N,N-dimethylamino)ethyl (meth)acrylate and glycidyl (meth)acrylate; vinyl esters such as vinyl acetate and vinyl propionate; nitrile group-containing monomers such as (meth)acrylonitrile; unsaturated carboxylic acids such as (meth)acrylic acid, maleic anhydride, fumaric acid, itaconic acid and crotonic acid; aromatic vinyl monomers such as styrene, α-methylstyrene and divinylbenzene; and N-substituted unsaturated carboxylic acid amides such as N-methylol (meth)acrylamide. Among these, those carrying a functional group such as a carboxyl group, a hydroxyl group, an amino group, a methylol group or a glycidyl group are preferably employed in the present invention.

If these unsaturated monomers (d) are used, the water resistance of the resulting copolymer emulsion (e) is greatly improved. The amount of these monomers copolymerizable with (meth)acrylamide is less than 50 parts by weight and preferably less than 30 parts by weight in 100 parts by weight of the monomer component (b). If the amount of the unsaturated monomer (d) exceeds 50 parts by weight, the heat resistance of the resulting emulsion layer is lowered and the polymerization of these monomer components (b) does not always proceed sufficiently.

The total amount of (meth)acrylamide (c) and the optional unsaturated monomer component (d) ranges from 5 to 500 parts by weight and preferably 10 to 200 parts by weight per 100 parts by weight of the solid contents of the seed emulsion (a).

If the amount of the monomer component (b) is less than 5 parts by weight, sufficient heat resistance (or resistance to sticking) and resistance to solvents cannot be attained, while if it exceeds 500 parts by weight, the water resistance of the resulting heat-sensitive material is impaired and further the viscosity of the resulting copolymer emulsion (e) becomes substantially high and hence the workability thereof is lowered.

The copolymer emulsion (e) used in the present invention can be prepared according to any conventional emulsion polymerization method. More specifically, a variety of polymer seed emulsions (a) are prepared or provided in advance followed by the preparation of the copolymer emulsion (e) or alternatively a seed emulsion (a) is prepared and subsequently the copolymerization of the monomer component (b) is performed to obtain the copolymer emulsion (e). In other words, the method for preparing the emulsion (e) is not limited to a specific one.

When a seed emulsion (a) or a copolymer emulsion (e) is prepared by the emulsion-polymerization, a surfactant may be optionally used for imparting stability to the emulsion. Specific examples of such surfactants are anionic surfactants such as sulfuric acid esters of higher alcohols, alkylbenzenesulfonic acid salts, aliphatic sulfonic acid salts and alkyldiphenyl ether sulfonic acid salts; nonionic surfactants such as alkyl esters of polyethylene glycols, alkyl phenyl ethers and alkyl ethers, which may be used alone or in combination of two or more of these. The amount of these surfactants is not restricted to a specific range, but they are preferably used in the lowest required amount.

A polymerization initiator is in general used in polymerization of the seed emulsion (a) and examples thereof are water soluble initiators such as persulfates and hydrogen peroxide; oil-soluble initiators such as benzoyl peroxide and azobisisobutyronitrile; or redox initiators. The amount of the polymerization initiators is not restricted to a particular range and is selected according to conventional techniques. However, the amount thereof used when the monomer component (b) including (meth)acrylamide (c) is copolymerized, ranges from 0.1 to 20 parts by weight and preferably 0.1 to 10 parts by weight per 100 parts by weight of the monomer.

In the polymerization or copolymerization, a molecular weight modifier (a chain transfer agent) is optionally used and is selected from the group consisting of mercaptans such as t-dodecylmercaptan and n-dodecylmercaptan and low molecular weight halogen atom-containing compounds.

Heat-sensitive recording materials having excellent water resistance and heat resistance as well as excellent color developing sensitivity can be obtained by incorporating the copolymer emulsion (e) thus prepared into an intermediate layer arranged between the substrate and the heat-sensitive recording layer of the heat-sensitive recording material and/or through the use thereof as a binder for a heat-sensitive recording layer applied onto the intermediate layer.

When the copolymer emulsion is used as a binder, it may be used singly or optionally in combination with other known binders as has been described above or further it may be used in combination with a water-soluble or water-dispersible epoxy compound and/or a known agent for improving water resistance (a crosslinking agent) such as amino-formaldehyde compound for the purpose of further improvements of the water resistance and heat resistance.

Examples of agents to be bound with these binders present in the intermediate layer are inorganic fillers such as calcium carbonate, clay, kaolin, talc and silica; and organic fine particles such as urea-formalin resin and polystyrene resin particles. In addition, examples of substances which are to be bound with the binder and present in the heat-sensitive recording layer are basic organic dyes such as fluorans, triallylmethanes and phenoxyazines and examples of developers are phenolic compounds or aromatic carboxylic acids.

The amount of the developers used in general ranges from 1 to 30 parts by weight per one part by weight of the dyes. The dyes and developers are separately dispersed in the foregoing copolymer emulsion (e) by wet-pulverizing them in the presence of the emulsion using, for instance, a ball mill. It is also possible to optionally use an inorganic pigment such as calcium carbonate, talc or kaolin; a UV absorber such as benzophenones or triazoles; a sensitizer such as waxes or a fatty acid amide in addition to the foregoing components.

The ratio of the binder and the substances to be bound is not critical and in general selected so that the substances to be bound are effectively fixed and bound onto the surface of a substrate and/or an intermediate layer, but the amount of the binder in general ranges from 5 to 30 parts by weight, preferably 10 to 20 parts by weight per 100 parts by weight of the substance to be bound.

The material thus formulated is in general applied in an amount ranging from 5 to 15 g/m$^2$ for the intermediate layer and 2 to 20 g/m$^2$ for the heat-sensitive layer (expressed in the amount thereof weighed after drying) according to any known manner using, for instance, a roll coater or a blade coater to thus give the heat-sensitive recording material of the present invention. Examples of substrates are paper and plastic sheets.

On the other hand, if the copolymer emulsion (e) is used for forming a protective layer of the heat-sensitive recording material, the resistance to sticking of the material is maintained or improved and the water resistance and the resistance to plasticizers of the heat-sensitive recording layer and hence the resulting recorded images are substantially improved. The protective layer may further comprise, as optional components, known multifunctional agents for imparting water resistance (crosslinking agents) such as water-soluble or water-dispersible epoxy compounds; lubricants such as higher fatty acid amides and metal salts of higher fatty acids for further improvement of the resistance to sticking of the layer; pH adjusting agents; thickeners; antifoaming agents; surfactants; preservatives, inorganic fillers; organic fine particles; and other auxiliary agents and additives.

In particular, the agents for imparting water resistance (crosslinking agents) have an ability of improving the durability and the heat resistance of the protective layer and are preferably employed, but the composition for forming a protective layer including a crosslinking agent has a so-called pot life and, therefore, it must be used depending on time and circumstances.

Moreover, a film-forming aid (f) may be used in the present invention. The incorporation thereof into the copolymer emulsion (e) makes it possible to temporarily plasticize the emulsion particles in order to ensure the coalescence of the particles and to hence substantially eliminate so-called defects of the coated film due to incomplete coalescence of these particles. Thus, the protective layer-forming ability of the copolymer emulsion (e) can be greatly improved. If a continuous coating film is simply formed from a resin emulsion, it would be possible to use glycol ethers such as monoalkyl ethers of ethylene glycol or monoalkyl ethers of diethylene glycol, but these materials exert influence on the heat-sensitive recording layer and cause fogging of an underlying layer or color development of the heat-sensitive recording layer in the worst case. Moreover, plasticizers such as phthalic acid esters and adipic acid esters are not preferred because of their effect of discoloration and fading on the recorded color developable portions. The film-forming aids used in the present invention for the foregoing purposes must be selected from those which do not adversely affect the heat-sensitive recording layer and they are preferably selected from the group consisting of 2,2,4-trimethyl-1,3-pentanediol, 2,2,4-trimethyl-1,3-pentanediol monoisobutyrate, 2,2,4-trimethyl-1,3-pentanediol diisobutyrate and benzyl alcohol among others.

The foregoing film-forming aids (f) used in the present invention are used in an amount ranging from 3 to 30 parts by weight and more preferably 5 to 15 parts by weight on the basis of the solid contents of the copolymer emulsion (e). This is because if the amount of the film-forming aid is less than 3 parts by weight, the desired effect of the film-forming aid cannot be expected, while if it exceeds 30 parts by weight, the polymer particles are excessively plasticized and the heat resistance of the copolymer emulsion (e) is impaired. Methods for incorporating the film-forming aid (f) into the copolymer emulsion (e) are not restricted to particular ones and the incorporation may be performed by adding the aid to the emulsion after preparing the emulsion or by adding the aid to the monomer component (b) during the copolymerization thereof.

The protective layer for the heat-sensitive recording material is applied onto the surface of known heat-sensitive recording materials as has been described above, i.e., onto the heat-sensitive color developing layer, between the substrate and the heat-sensitive color developing layer, onto the back surface of the substrate or the like so as to form a layer having a thickness ranging from 1 to several microns determined after drying, whereby the resistance to sticking of the material is maintained or improved and simultaneously the durability such as water resistance and resistance to plasticizers of the heat-sensitive recording layer and hence the resulting recorded images can be substantially improved.

The present invention will hereunder be explained in more detail with reference to the following non-limitative working Examples and preparation Examples and the effects practically attained by the present invention will also be discussed in detail in comparison with the following Comparative Examples. In the following Examples, Preparation Examples and Comparative Examples, the terms "part" and "%" mean "part by weight" and "% by weight" respectively unless otherwise specified.

PREPARATION OF COPOLYMER EMULSIONS A TO J

Preparation Example A

To a separable flask equipped with a stirrer and a reflux condenser, there were added 60 parts of water, 0.1 part of sodium dodecylbenzenesulfonate and 1.0 part of potassium persulfate, the air in the flask was replaced with nitrogen gas and then the temperature of the contents of the flask was raised to 70° C. Then an emulsion of monomers having the following composition was continuously poured into the flask over about 4 hours, then the monomers were polymerized for about 5 hours to give a seed emulsion (S-1) having a solid content of about 50%.

| Composition of the Monomers Emulsion | |
|---|---|
| styrene | 50 parts |
| 2-ethylhexyl acrylate | 42 parts |
| 2-hydroxyethyl methacrylate | 5 parts |
| methacrylic acid | 2 parts |
| N-methylol methacrylamide | 1 part |
| n-dodecylmercaptan | 0.1 part |
| water | 40 parts |
| sodium dodecylbenzenesulfonate | 0.3 part |

Then to a similar separable flask, there were added 400 parts of the seed emulsion (S-1) and 10 parts of ammonium persulfate, the air in the flask was replaced with nitrogen gas and then the temperature of the contents of the flask was raised to 70° C. Thereafter, an aqueous solution obtained by dissolving 50 parts of acrylamide and 50 parts of methacrylamide in 500 parts of water was continuously poured into the flask over about 2 hours, followed by the polymerization for about 2 hours to give a copolymer emulsion A having a solid content Of about 30%.

Preparation Example B

To a separable flask equipped with a stirrer and a reflux condenser, there were added 60 parts of water, 0.1 part of sodium dodecylbenzenesulfonate and 1.0 part of potassium persulfate, the air in the flask was replaced with nitrogen gas and then the temperature of the contents of the flask was raised to 70° C. Then an emulsion of monomers having the following composition was continuously poured into the flask over about 4 hours, then the monomers were polymerized for about 4 hours to give a seed emulsion (S-2) having a solid content of about 50%.

| Composition of the Monomers Emulsion | |
|---|---|
| methyl methacrylate | 47.5 parts |
| butyl acrylate | 47.5 parts |
| 2-hydroxyethyl methacrylate | 3 parts |
| acrylic acid | 2 parts |
| n-dodecylmercaptan | 0.2 part |
| water | 40 parts |
| sodium dodecylbenzenesulfonate | 0.3 part |

Then to a similar separable flask, there were added 100 parts of the seed emulsion (S-2), 200 parts of water and 100 parts of acrylamide, the air in the flask was replaced with nitrogen gas and then the temperature of the contents of the flask was raised to 50° C. and after the acrylamide was completely dissolved, it was raised to 70° C. Thereafter, an aqueous solution obtained by dissolving 5 parts of ammonium persulfate in 100 parts of water was continuously poured into the flask over about 3 hours, followed by the polymerization for about 3 hours to give a copolymer emulsion B having a solid content of about 30%.

Preparation Example C

To a separable flask equipped with a stirrer and a reflux condenser, there were added 60 parts of water, 0.1 part of sodium dodecylbenzenesulfonate and 1.0 part of potassium persulfate, the air in the flask was replaced with nitrogen gas and then the temperature of the contents of the flask was raised to 70° C. Then an emulsion of monomers having the following composition was continuously poured into the flask over about 4 hours, then the monomers were polymerized for about 4 hours to give a seed emulsion (S-3) having a solid content of about 50%.

| Composition of the Monomers Emulsion | |
|---|---|
| acrylonitrile | 46 parts |
| butyl acrylate | 46 parts |
| 2-hydroxyethyl methacrylate | 5 parts |
| methacrylic acid | 3 parts |
| n-dodecylmercaptan | 0.1 part |
| water | 40 parts |
| sodium dodecylbenzenesulfonate | 0.3 part |

Then to a similar separable flask, there were added 200 parts of the seed emulsion (S-3), 110 parts of water, 90 parts of methacrylamide and an aqueous solution previously prepared by dissolving 10 parts of methacrylic acid in 150 parts of 2% aqueous ammonia, the air in the flask was replaced with nitrogen gas and then the temperature of the contents of the flask was raised to 50° C. and after the methacrylamide was completely dissolved, it was raised to 70° C. Thereafter, an aqueous solution obtained by dissolving 5 parts of ammonium persulfate in 100 parts of water was added to the flask, followed by the polymerization for about 3 hours to give a copolymer emulsion C having a solid content of about 30%.

Preparation Example D

As in the same manner used in Preparation Example A, 4,000 parts of the seed emulsion (S-1) were obtained by polymerization and subsequently 90 parts of water and 100 parts of acrylamide were added to the polymerization product. The flask was freshly replaced with nitrogen gas and then the temperature was raised up to 70° C. After the acrylamide was completely dissolved, an aqueous solution separately prepared by dissolving one part of ammonium persulfate in 10 parts of water was added to the flask, followed by the polymerization for about 3 hours to give a copolymer emulsion D having a solid content of about 50%.

Preparation Example E

The same seed emulsion (S-2) was prepared according to the same procedures used in Preparation Example B. Then to the same separable flask, there were added 2,000 parts of the seed emulsion (S-2), 375 parts of water, 70 parts of methacrylamide and an aqueous solution separately prepared by dissolving 30 parts of acrylic acid in 90 parts of 8% aqueous ammonia, the air in the flask was replaced with nitrogen gas, and then the temperature of the flask was raised up to 50° C. After the methacrylamide was completely dissolved, the temperature was raised to 70° C., then an aqueous solution separately prepared by dissolving 10 parts of ammonium persulfate in 200 parts of water was added to the flask, followed by the polymerization for about 3 hours to give a copolymer emulsion E having a solid content of about 40%.

Preparation Example F

The same seed emulsion (S-3) was prepared according to the same procedures used in Preparation Example C. Then to the same separable flask, there were added 40 parts of the seed emulsion (S-3), 240 parts of water and 100 parts of methacrylamide, the air in the flask was replaced with nitrogen gas, and then the temperature of the flask was raised up to 50° C. After the methacrylamide was completely dissolved, the temperature was raised to 70° C., then an aqueous solution separately prepared by dissolving 5 parts of ammonium persulfate in 100 parts of water was added to the flask, followed by the polymerization for about 4 hours to give a copolymer emulsion F having a solid content of about 25%.

Preparation Example G

The same seed emulsion (S-1) was prepared according to the same procedures used in Preparation Example A. Then to the same separable flask, there were added 8,000 parts of the seed emulsion (S-1) and 100 parts of acrylamide, the air in the flask was replaced with nitrogen gas, and then the temperature of the flask was raised up to 70° C. After the acrylamide was completely dissolved, an aqueous solution separately prepared by dissolving 5 parts of ammonium persulfate in 100 parts of water was added to the flask, followed by the polymerization for about 3 hours to give a copolymer emulsion G having a solid content of about 50%.

Preparation Example H

The same seed emulsion (S-2) was prepared according to the same procedures used in Preparation Example E. Then to the same separable flask, there were added 2,000 parts of the seed emulsion (S-2), 315 parts of water, 50 parts of methacrylamide and an aqueous solution separately prepared by dissolving 50 parts of acrylic acid in 150 parts of 8% aqueous ammonia, the air in the flask was replaced with nitrogen gas, and then the temperature of the flask was raised up to 50° C. After the methacrylamide was completely dissolved, the temperature was raised to 70° C., then an aqueous solution separately prepared by dissolving 10 parts of ammonium persulfate in 200 parts of water was added to the flask, followed by the polymerization for about 3 hours to give a copolymer emulsion H having a solid content of about 40%.

Preparation Example J

The same seed emulsion (S-3) was prepared according to the same procedures used in Preparation Example F. Then to the same separable flask, there were added 20 parts of the seed emulsion (S-3), 235 parts of water and 100 parts of methacrylamide, the air in the flask was replaced with nitrogen gas, and then the temperature of the flask was raised up to 50° C. After the methacrylamide was completely dissolved, the temperature was raised to 70° C., then an aqueous solution separately prepared by dissolving 5 parts of ammonium persulfate in 100 parts of water was added to the flask, followed by the polymerization for 3 hours to give a copolymer emulsion J having a solid content of about 25%.

Comparative Preparation Example K

The seed emulsion (S-1) having a solid content of about 50% prepared in Preparation Example A as such was used as comparative copolymer emulsion K.

Comparative Preparation Example L

The same procedures used in Preparation Example A were repeated except that 50 parts of acrylic acid and 50 parts of methacrylic acid were substituted for 50 parts of acrylamide and 50 parts of methacrylamide used in Preparation Example A, respectively to give a copolymer emulsion which was used as comparative copolymer emulsion L.

The composition of the copolymer emulsions A to L thus prepared and the results of these polymerization procedures are summarized in the following Table 1.

Examples will now be described in detail below, in which the foregoing copolymer emulsions were used in an intermediate layer and a heat sensitive recording layer to give the corresponding heat sensitive recording materials. In all the following Examples, the composition is expressed in "parts by weight" unless otherwise specified.

EXAMPLE 1 i) Preparation of Composition for Intermediate Layer:

| | |
|---|---|
| copolymer emulsion A (Preparation Example A) | 100 |
| calcium carbonate light | 125 |
| water | 100 |

ii) Compounded Solution for Heat-Sensitive Recording Layer Solution A:

| Solution A: | |
|---|---|
| 3-dimethylamino-6-methyl-7-anilinofluoran | 20 |

-continued

| Solution A: | |
|---|---|
| copolymer emulsion A (Preparation Example A) | 5 |
| water | 75 |

| Solution B: | |
|---|---|
| bisphenol A | 20 |
| copolymer emulsion A (Preparation Example A) | 5 |
| Petrolight R-50 (microcrystalline wax; available from Harico Co., Ltd.) | 5 |
| water | 70 |

The foregoing compounded solution was dispersed by a sand mill for 6 to 8 hours to give a coating color. The foregoing compounded coating color for intermediate layers was applied onto commercially available wood free paper (basis weight of about 50 g/m$^2$) with a bar coater so that the coated amount thereof weighed after drying was equal to 15 g/m$^2$ and then dried. Then the compounded coating color for heat-sensitive recording layer was likewise applied onto the intermediate layer in an amount of 15 g/m$^2$ (weighed after drying) and dried to give a heat-sensitive recording material.

EXAMPLES 2 TO 6

The same procedures used in Example 1 were repeated except that copolymer emulsion B to F was substituted for copolymer emulsion A to give the corresponding heat-sensitive recording material, provided that the solid contents of the emulsions serving as the binder were adjusted by the addition of water so that they were equal to one another.

EXAMPLE 7

To each formulated coating color obtained in Example 3, there were added an epoxy polyamide resin, Euramine P-5600 (solid content of 30%; available from MITSUI TOATSU CHEMICALS, INC.) in an amount of 5 parts (expressed in terms of solid content) per 100 parts of the copolymer emulsion and a heat-sensitive recording material was prepared in the same manner.

EXAMPLE 8

A heat-sensitive recording material was prepared according to the same manner used in Example 7 except that the copolymer emulsion E obtained in Preparation Example E was used.

EXAMPLES 9 TO 11

The same procedures used in Examples 2 to 6 were repeated except that the copolymer emulsions G to J obtained in Preparation Examples G to J were used to give heat-sensitive recording materials.

EXAMPLE 12

A heat-sensitive recording material was prepared according to the same manner used in Example 7 except that the copolymer emulsion H obtained in Preparation Example H was used.

COMPARATIVE EXAMPLE 1

Each coating color was prepared in the same manner used in Example 1 except that a 10% aqueous solution of polyvinyl alcohol (degree of saponification 99%; degree of polymerization 1,700) was used, then 15 parts of a 30% aqueous glyoxal solution and 18 parts of a 5% aqueous solution of ammonium chloride were added and heat-sensitive recording materials were prepared in the same manner.

COMPARATIVE EXAMPLE 2

The same procedures used in Example 1 were repeated except that only the 10% aqueous solution of polyvinyl alcohol (degree of saponification 99%; degree of polymerization 1,700) used in Comparative Example 1 was used to give a heat-sensitive recording material.

COMPARATIVE EXAMPLE 3 TO 4

The same procedures used in Example 1 were repeated except that the copolymer emulsions K and L obtained in Comparative Preparation Examples K and L were used to give heat-sensitive recording materials.

The following properties of each heat-sensitive recording material thus obtained were determined according to the following methods. The results obtained are listed in the following Table 2.

(1) Water Resistance

The heat-sensitive recording part of each heat-sensitive recording material which had been color-developed through printing was rubbed with gauze containing water over 20 times using GAKUSHIN TYPE Tester for fastness to rubbing (without any load) and then the extent of portions of the heat-sensitive recording layer which were peeled off was visually evaluated according to the following three-stage evaluation criteria:

○: not peeled off

Δ: peeled off to some extent, but the printed letter can be recognized.

x : severely peeled off and the printed letter cannot be recognized.

(2) Color Developing Sensitivity

The heat-sensitive recording layer was color-developed under the following conditions utilizing a heat-sensitive paper printing machine (TH-PMD; available from OKURA ELECTRICS, INC.) and the density of the printed letters was determined with a Macbeth densitometer.

Voltage applied: 24 V
Pulse width: 1.74 ms
Energy applied: 0.34 mJ/dot

(3) Heat Resistance

The measurement was performed under the same conditions as those used in the color developing sensitivity test to examine setting up of noises (cracking sound) and the sticking properties and these were synthetically judged according to the following evaluation criteria:

○: no noise was produced and paper could be smoothly supplied

Δ: some noises were generated x: noises were generated and severe sticking was observed As seen from the results listed in Table 2, the heat-sensitive recording materials obtained in Examples 1 to 12 according to the present invention were superior to those obtained in Comparative Examples 1 to 4, in particular those obtained in Examples 1 to 8 were excellent.

Examples in which the foregoing copolymer emulsions were used for preparing protective layers for a heat-sensitive recording material will now be described below.

EXAMPLE 13

The copolymer emulsion A obtained in Preparation Example A was applied onto the surface of commercially available heat-sensitive recording paper (paper for facsimile) and then dried to form a protective layer in an amount of 2 g/m$^2$ (thickness=about 2$\mu$) on the paper.

EXAMPLES 14 TO 18

The same procedures used in Example 13 were repeated except that each of the copolymer emulsions B to F obtained in Preparation Examples B to F was used to form a protective layer.

EXAMPLES 19 AND 20

The same procedures used in Example 13 were repeated except that each of the copolymer emulsions C and E obtained in Preparation Examples C and E to which 5% (in terms of the solid content) of Euramine P-5500 (solid content: 12.5%; available from MITSUI TOATSU CHEMICAL, INC.) had been added was used to form a protective layer.

EXAMPLES 21 TO 23

The same procedures used in Example 13 were repeated except that each of the copolymer emulsions G to J obtained in Preparation Examples G to J was used to form a protective layer.

EXAMPLES 24

The same procedures used in Example 19 were repeated except that the copolymer emulsion H obtained in Preparation Example H was used to form a protective layer.

COMPARATIVE EXAMPLE 5

The same procedures used in Example 13 were repeated except for using a solution obtained by adding 15 parts of a 30% glyoxal aqueous solution and 18 parts of a 5% ammonium chloride aqueous solution to 100 parts of a 10% aqueous solution of polyvinyl alcohol (degree of saponification: 99%; degree of polymerization: 2,000) to form a protective layer.

COMPARATIVE EXAMPLE 6

The same procedures used in Example 13 were repeated except for using only the 10% aqueous solution of polyvinyl alcohol (degree of saponification: 99%; degree of polymerization: 2,000) used in Comparative Example 6 to form a protective layer.

COMPARATIVE EXAMPLES 7 TO 8

The same procedures used in Example 13 were repeated except that each of the copolymer emulsions K and L obtained in Comparative Preparation Examples K and L was used to form a protective layer.

The heat-sensitive recording paper to which the protective layer was thus applied were color-developed using a heat-sensitive paper-color developing test device (TH-PMD; available from OKURA ELECTRICS, CO.,LTD.) to determine a variety of durabilities.

Voltage applied: 24 V
Pulse width: 1.74 ms
Energy applied: 0.34 mJ/dot

The results obtained are summarized in the following Table 3.

The evaluation of these durabilities were performed according to the following methods:

Water Resistance

The heat-sensitive recording part of each heat-sensitive recording material which had been color-developed through printing was rubbed with gauze containing water over 20 times using GAKUSHIN TYPE Tester for fastness to rubbing (without any load) and then the extent of portions of the heat-sensitive recording layer which were peeled off was visually evaluated according to the following three-stage evaluation criteria:

○: not peeled off
Δ: peeled off to some extent, but the printed letter can be recognized.
x: severely peeled off and the printed letter cannot be recognized.

Resistance to Oils (Resistance to Solvents)

A drop of an oil for frying was dropped on the heat-sensitive recording part which had been color-developed by printing, spreaded by lightly wiping away with gauze, the heat-sensitive recording part thus treated was allowed to stand at room temperature for 6 hours and the extent of fading thereof was visually judged according to the following evaluation criteria:

◎: no change
○: not faded
Δ: slightly faded
x: severely faded

Resistance to Plasticizer

The heat-sensitive recording part which had been color-developed by printing was wrapped with a polyvinyl chloride sheet containing a plasticizer in triple layers, a glass plate of 2 cm ×2 cm was put on the assembly with a load of 50 g, allowed to stand for 24 hours at room temperature and the degree of fading was visually evaluated according to the following evaluation criteria:

◎: no change
○: not faded
Δ: slightly faded
x: discolored

Resistance to Sticking

The resistance to sticking was judged from the noise generated during printing operation according to the following evaluation criteria:

○: no noise due to sticking was generated
Δ: almost noise due to sticking was generated
x: severe noise due to sticking was generated

Workability

The handling properties such as stability, effective density and viscosity as well as the ease of process control were synthetically judged according to the following evaluation criteria. In this test, the composition for forming a protective layer comprised a crosslinking agent.

○: good
Δ: medium
x: bad

As seen from the results listed in Table 3, the heat-sensitive recording materials obtained in Examples 13 to 24 were superior to those obtained in Comparative Examples 5 to 8, in particular those in Examples 13 to 20 were excellent.

EXAMPLE 25

A copolymer emulsion was prepared in the same manner used in Preparation Example A followed by the addition of 30 parts of 2,2,4-trimethyl-1,3-pentanediol as a film-forming aid to give a copolymer emulsion A' having a solid content of about 30%. This emulsion is a protective layer-forming composition containing 10 parts of the film-forming aid per 10 parts of the solid contents of the emulsion. The copolymer emulsion A was applied onto the surface of commercially available heat-sensitive recording paper (paper for facsimile) and then dried to give a protective layer. The coated amount thereof was 2 g/m$^2$ (thickness=about 2 $\mu$).

EXAMPLES 26 TO 29

In the same manner used in Example 25, copolymer emulsions B to F were prepared followed by the addition of each film-forming aid in a desired amount listed in Table 4 to thus give corresponding protective layer-forming compositions. A protective layer was formed on the surface of commercially available heat-sensitive recording paper using each resulting protective layer-forming composition in the same manner used in Example 25.

EXAMPLE 30

The same procedures used in Example 25 were repeated except that a copolymer emulsion obtained by adding 5% of the aforementioned Euramine P-5500 (expressed in terms of solid content) to the copolymer emulsion obtained in Example 27 was employed to give a protective layer.

EXAMPLES 31 TO 32

In the same manner used in Example 25, copolymer emulsions G to J were prepared followed by the addition of each film-forming aid in a desired amount listed in Table 4 to thus give corresponding protective layer-forming compositions. A protective layer was formed on the surface of commercially available heat-sensitive recording paper using each resulting protective layer-forming composition in the same manner used in Example 25.

COMPARATIVE EXAMPLES 9 TO 11

In the same manner used in Example 25, copolymer emulsions K and L were prepared followed by the addition of each film-forming aid in a desired amount listed in Table 4 to thus give corresponding protective layer-forming compositions. A protective layer was formed on the surface of commercially available heat-sensitive recording paper using each resulting protective layer-forming composition.

The properties of these heat-sensitive recording materials were determined according to the foregoing methods employed for obtaining the data listed in Table 3. The results obtained are summarized in Table 4 given below.

As seen from the results listed in Table 4, the heat-sensitive recording materials obtained in Examples 25 to 32 were superior to those obtained in Comparative Examples 5, 6 and 9 to 11, in particular those in Examples 25 to 30 were excellent.

Thus, it is clear, from the results listed in Tables 1 and 2, that a heat-sensitive recording material whose recording layer and hence the resulting recorded images are excellent in water resistance and heat resistance (resistance to sticking) as well as color developing sensitivity can be obtained if a specific copolymer emulsion is used as a binder for the heat-sensitive recording material.

Moreover, if the specific copolymer emulsion according to the present invention is used as a material for forming a protective layer of the heat-sensitive recording material, the durability of the recording layer and the recorded images of the heat-sensitive recording material is greatly improved and the resistance to sticking thereof is maintained or improved compared with those for the conventional heat-sensitive recording materials.

TABLE 1

| | | Preparation Example | | | | | | | | | Comparative Preparation Example | |
|---|---|---|---|---|---|---|---|---|---|---|---|---|
| | | A | B | C | D | E | F | G | H | J | K | L |
| a | Seed Emulsion (solid content: 50%) | (S-1) 400 | (S-2) 100 | (S-3) 200 | (S-1) 4000 | (S-2) 2000 | (S-3) 40 | (S-1) 8000 | (S-2) 2000 | (S-3) 20 | (S-1) | (S-1) 400 |
| b c | Acrylamide | 50 | 100 | 0 | 100 | 0 | 0 | 100 | 0 | 0 | — | 0 |
| | Methacrylamide | 50 | 0 | 90 | 0 | 70 | 100 | 0 | 50 | 100 | — | 0 |
| d | Acrylic acid | 0 | 0 | 0 | 0 | 30 | 0 | 0 | 50 | 0 | — | 50 |
| | Methacrylic acid | 0 | 0 | 10 | 0 | 0 | 0 | 0 | 0 | 0 | — | 50 |
| e | Solid Content of Copolymer Emulsion | 30 | 30 | 30 | 50 | 40 | 25 | 50 | 40 | 25 | 50 | 30 |
| | Polymerization Stability | ○ | ○~Δ | ○ | ○ | ○~Δ | Δ | ○ | Δ~x | Δ | ○ | x |
| a (solid content)/b | | 100/50 | 100/200 | 100/100 | 100/5 | 100/10 | 100/500 | 100/2.5 | 100/10 | 100/1000 | 100/0 | 100/50 |
| b/c | | 100/100 | 100/100 | 100/90 | 100/100 | 100/70 | 100/100 | 100/100 | 100/50 | 100/100 | — | 100/0 |

TABLE 2

| | Binder | | Properties Evaluated | | |
|---|---|---|---|---|---|
| | Copolymer Emulsion | Crosslinking Agent | Water Resistance | Color-developing Sensitivity | Resistance to Sticking |
| Example 1 | A | — | ○ | 1.35 | ○ |
| Example 2 | B | — | Δ~○ | 1.37 | ○ |
| Example 3 | C | — | ○ | 1.34 | ○ |
| Example 4 | D | — | ○ | 1.34 | Δ |
| Example 5 | E | — | ○ | 1.38 | ○ |
| Example 6 | F | — | Δ | 1.20 | ○ |
| Example 7 | C | P-5600 | ○ | 1.30 | ○ |
| Example 8 | E | P-5600 | ○ | 1.35 | ○ |
| Example 9 | G | — | ○ | 1.10 | Δ |
| Example 10 | H | — | ○ | 1.15 | ○~Δ |
| Example 11 | J | — | Δ | 1.20 | ○ |
| Example 12 | H | P-5600 | ○ | 1.15 | ○~Δ |
| Comp. Ex. 1 | P V A | glyoxal | x | 1.10 | Δ |
| Comp. Ex. 2 | P V A | — | xx | 1.13 | Δ~x |
| Comp. Ex. 3 | K | — | ○ | 1.36 | xx |
| Comp. Ex. 4 | L | — | ○ | 1.29 | x |

TABLE 3

| | Protective Layer-Forming Composition | | Properties Evaluated | | | | |
|---|---|---|---|---|---|---|---|
| | Copolymer Emulsion | Crosslinking Agent | Water Resistance | Resistance to Oils | Resistance to Plasticizers | Resistance to Sticking | Workability |
| Example 13 | A | — | ○ | ○ | ○ | ○ | ○ |
| Example 14 | B | — | ○~Δ | ○ | ○ | ○ | ○ |
| Example 15 | C | — | ○~Δ | ○ | ○ | ○ | ○ |
| Example 16 | D | — | ○ | Δ | ○~Δ | Δ | ○ |
| Example 17 | E | — | ○ | ○~Δ | ○~Δ | ○~Δ | ○ |
| Example 18 | F | — | Δ | ○ | ○ | ○ | ○~Δ |
| Example 19 | C | P-5500 | ○ | ○ | ○ | ○ | Δ |
| Example 20 | E | P-5500 | ○ | ○ | ○ | ○ | Δ |
| Example 21 | G | — | ○ | Δ~x | Δ | Δ~x | ○ |
| Example 22 | H | — | ○ | Δ | Δ | ○~Δ | ○~Δ |
| Example 23 | J | — | x | ○ | ○ | ○ | Δ |
| Example 24 | H | P-5500 | ○ | ○~Δ | ○~Δ | ○~Δ | Δ |
| Comp. Ex. 5 | P V A | glyoxal | Δ | ○~Δ | ○ | ○ | x |
| Comp. Ex. 6 | P V A | — | xx | Δ | Δ | Δ | ○~Δ |
| Comp. Ex. 7 | K | — | ○ | x | x | xx | ○ |
| Comp. Ex. 8 | L | — | x | Δ | x | Δ | x |

TABLE 4

| | Protective Layer-Forming Composition | | | | Properties Evaluated | | | | |
|---|---|---|---|---|---|---|---|---|---|
| | Copolymer Emulsion | Crosslinking Agent | Film-Forming Aid Kind | Film-Forming Aid Content | Water Resistance | Resistance to Oils | Resistance to Plasticizers | Resistance to Sticking | Workability |
| Example 25 | A | — | (a) | 10 parts | ○ | ○ | ◎ | ○ | ○ |
| Example 26 | B | — | (b) | 10 | ○~Δ | ○ | ◎ | ○ | ○ |
| Example 27 | C | — | (b) | 10 | ○~Δ | ◎ | ◎ | ○ | ○ |
| Example 28 | D | — | (c) | 30 | ○ | ○~Δ | ○ | Δ | ○ |
| Example 29 | F | — | (d) | 3 | Δ | ○ | ◎ | ○ | ○~Δ |
| Example 30 | C | P-5500 | (b) | 10 | ○ | ◎ | ◎ | ○ | Δ |
| Example 31 | G | — | (b) | 10 | ○ | Δ | ○ | Δ~x | ○ |
| Example 32 | J | — | (b) | 10 | x | ○ | ◎ | ○ | Δ |
| Comp. Ex. 5 | P V A | glyoxal | — | — | Δ | ○~Δ | ○ | ○ | x |
| Comp. Ex. 6 | P V A | — | — | — | xx | Δ | ○~Δ | ○~Δ | ○~Δ |
| Comp. Ex. 9 | C | — | (b) | 40 | ○ | ○ | ◎ | x | Δ |
| Comp. Ex. 10 | K | — | (b) | 10 | ○ | Δ | Δ | xx | ○ |
| Comp. Ex. 11 | L | — | (b) | 10 | x | Δ | Δ | Δ | x |

(a) 2,2,4-trimethyl-1,3-pentanediol
(b) 2,2,4-trimethyl-1,3-pentanediol monoisobutyrate
(c) 2,2,4-trimethyl-1,3-pentanediol diisobutyrate
(d) benzyl alcohol

We claim:

1. A heat-sensitive recording material wherein the heat-sensitive recording material comprises (i) a substrate, (ii) an intermediate layer formed on the substrate and (iii) a heat-sensitive recording layer formed on the intermediate layer, said heat-sensitive recording layer comprising a coloring agent and a developer capable of color developing the coloring agent and wherein at least one of the intermediate layer and the heat-sensitive recording layer comprise a polymer emulsion (e) as a binder, the polymer emulsion being obtained by polymerizing 2.5 to 1000 parts by weight of a monomer component (b) which comprises 50 to 100% by weight of (meth)acrylamide (c) and 50 to 0% by weight of an unsaturated monomer component (d) copolymerizable with (meth)acrylamide in the presence of 100 parts by weight of the solid content of a seed emulsion (a) serving as a nucleating particle.

2. The heat-sensitive recording material of claim 1 wherein at least one of the intermediate layer and the heat-sensitive recording layer comprise the polymer emulsion (e) as a binder and at least one member selected from the group consisting of 2,2,4-trimethyl-1,3-pentanediol,2,2,4-trimethyl-1,3-pentanediol monoisobutyrate, 2,2,4-trimethyl-1,3-pentadiol diisobutyrate and benzyl alcohol as a film-forming aid (f).

3. A heat-sensitive recording material wherein the heat-sensitive recording material comprises (i) a substrate, (ii) an intermediate layer formed on the substrate, (iii) a heat-sensitive recording layer formed on the intermediate layer, said heat-sensitive recording layer comprising a coloring agent and a developer capable of color-developing the coloring agent and (iv) a protective layer formed on the heat-sensitive recording layer and wherein the protective layer comprises a polymer emulsion (e), the polymer emulsion being obtained by polymerizing 2.5 to 1000 parts by weight of a monomer component (b) which comprises 50 to 100% by weight of (meth)acrylamide (c) and 50 to 0% by weight of an unsaturated monomer component (d) copolymerizable with (meth)acrylamide in the presence of 100 parts by weight of the solid content of a seed emulsion (a) serving as a nucleating particle.

4. The heat-sensitive recording material of claim 3 wherein the protective layer comprises the polymer emulsion (e) and at least one member selected from the group consisting of 2,2,4-trimethyl-1,3-pentadiol,2,2,4-trimethyl-1,3-pentane-diol monoisobutyrate,2,2,4-trimethyl-1,3-pentadiol diisobutyrate and benzyl alcohol as a film-forming aid (f).

5. The heat-sensitive recording material of claim 4 wherein the film-forming aid (f) is used in an amount ranging from 3 to 30 parts by weight per 100 parts by weight of the solid content of the polymer emulsion (e).

* * * * *